US005394861A

United States Patent [19]

Stegmaier

[11] Patent Number: 5,394,861

[45] Date of Patent: Mar. 7, 1995

[54] VAPOR-COLLECTING HOOD ESPECIALLY FOR A COMMERCIAL KITCHEN

[75] Inventor: Gert W. Stegmaier, Göppingen, Germany

[73] Assignee: Maimer GmbH, Schlierbach, Germany

[21] Appl. No.: 198,910

[22] Filed: Feb. 18, 1994

[30] Foreign Application Priority Data

Feb. 23, 1993 [EP] European Pat. Off. ..... 93102796

[51] Int. Cl.[6] ..... F24C 15/20

[52] U.S. Cl. ..... 126/299 D; 55/DIG. 36

[58] Field of Search ..... 126/299 R, 299 D; 55/DIG. 36

[56] References Cited

U.S. PATENT DOCUMENTS 3,425,334 2/1969 Brown et al. ..... 126/299 D

*Primary Examiner*—Carroll B. Dority

*Attorney, Agent, or Firm*—Herbert Dubno

[57] ABSTRACT

A vapor-collecting hood for a commercial kitchen has downwardly open collecting vapor spaces formed by the grease separating cells which have intake openings adapted to be selectively blocked by shutters. All of the shutters are mounted upon a common shutter carrier and are displaceable therewith from positions in which the openings are unblocked into positions in which the openings are blocked.

20 Claims, 7 Drawing Sheets

VAPOR-COLLECTING HOOD ESPECIALLY FOR A COMMERCIAL KITCHEN

FIELD OF THE INVENTION

The present invention relates to a vapor-collecting hood, especially for use in a commercial kitchen, and, more particularly, to a vapor-collecting hood of the type which comprises a multiplicity of grease-separating cells disposed adjacent one another and each of which has a downwardly open vapor-collecting space, a suction opening connected to a suction duct through which air is withdrawn, and a grease filter disposed between the intake opening and the suction duct.

BACKGROUND OF THE INVENTION

In commercial kitchens, the steam and vapor carrying latent heat, and the sensible heat produced within the kitchen must be carried off by appropriate ventilating means to maintain reasonable temperature and humidity conditions within the kitchen so that these conditions are tolerable by the kitchen personnel and do not affect adversely the cooking process.

In other words, the ventilation must be so dimensioned that predetermined temperature and moisture levels in the kitchen are not exceeded.

This requires generally a certain air replacement rate with which fresh outside air is supplied to the kitchen and kitchen air with the sensible heat and steam and vapor with the latent heat are withdrawn.

During periods in which the facility must be heated, generally in the winter, the supplied air must be heated to prevent the kitchen personnel from being chilled and to prevent detrimental temperature drops which might interfere with the cooking process. Furthermore, because relatively large amounts of air must be circulated, the heating may be relatively costly with respect to the energy which must be supplied to the air.

In determining the amount of air which must be circulated, therefore, one must consider on the one hand the cooking units which are in operation in the kitchen and may contribute comparatively large amounts of water vapor and hence latent heat, namely, boiling equipment, frying and water baths and steam tables which are commonly present in such kitchens. It is also necessary to consider cooking devices which contribute primarily radiant heat and/or convection heat to the atmosphere in the kitchen, i.e. sensible heat. These can include grills, ovens, tilting pans and the like. The type of heat which makes the most significant contributions to the air circulation, therefore, will depend on the facilities in the kitchen.

To minimize the amount of heat energy which must be supplied for the heating of the cold supplied fresh air, two basically different approaches are employed. In one approach heat is removed from the discharged air and used to preheat the incoming air by heat exchangers. A drawback of this system is that the discharged air normally contains residual grease which can condense in the heat exchangers and requires maintenance thereof at high cost. The other approach utilizes a so-called short circuit or induction hood in which a part of the supplied air is blown via a nozzle directly into the vapor collection space and thus is immediately drawn out in a short circuiting of the fresh air supply. In winter in which less sensible heat must be extracted, this short circuiting allows less flow from the kitchen of already heated air while nevertheless supplying a sufficient velocity with the aid of the unheated external air to permit the grease filter in the hood to remain effective and maintain the high degree of grease removal which is necessary. It should be understood, in this regard that the grease filter generally operates as an impingement or baffle filter in which the relatively high velocity is necessary for a high degree of grease separation.

The drawback of this approach, however, is that the introduction of unheated outside air into the kitchen and hood requires expensive and careful control of the air intake because any of this air which is not immediately discharged will alter the climate within the kitchen.

Objects of the Invention

It is therefore an object of the present invention to provide an improved vapor-collecting hood, especially for a commercial kitchen, which can be adjusted rapidly and simply to different operating conditions as required and, therefore, enables economical operation with high efficiency to achieve a higher degree of grease removal in the filter while facilitating cleaning and maintenance.

Another object of my invention is to provide an improved vapor-collecting hood for the purposes described which will be free from drawbacks of prior art.

SUMMARY OF THE INVENTION

These objects and other which will become apparent hereinafter are attained, in accordance with the invention, in a vapor-collecting hood whose grease-collecting cells in the region of the intake openings are provided with a jalousie carrier which is common to all of the grease-separating cells and is displaceable substantially transversely to the intake openings and is connected with shutters which are displaceable by the jalousie carrier into a position in which the intake openings are unblocked or into positions in which the intake openings are sealed.

An important advantage of the invention is that the individual grease-separating cells can each be provided with a shutter and can be taken out of the air circulation. It permits the total air throughput to be reduced without materially reducing the velocity in the grease filters of the grease separating cells to be so reduced that the grease filters become ineffective.

More particularly, by mounting the shutters on a common carrier, I can omit such shutters of certain grease-collecting cells while others are provided with the shutters so that the unobstructed openings will continuously circulate air from the kitchen while the cells provided with these shutters can be controlled as to the air flow therethrough to satisfy the needs for air circulation and remove the heat generated in the kitchen under the specific atmospheric conditions and kitchen conditions which may arise. The grease-collecting cells themselves can be inserted or removed depending upon the layout of the heat and vapor-generating units in the kitchen and, of course, when a fat-collecting cell is removed, its outlet to the plenum from which the air is withdrawn in the hood can be closed off and the respective shutter on the common carrier can be eliminated.

When a grease-collecting cell is inserted, it can have its intake opening completely unblocked, i.e. this opening need not be provided with a shutter, or a respective shutter can be affixed to the carrier to control the air flow through the specific grease-collecting trap or cell.

It is possible according to the invention to provide the shutters in the regions of the hood in which as a rule a reduced air exchange is required. The hood thus makes it possible to adjust the flow of air through the system simply to summer or winter operation and to different conditions of latent heat and sensible heat generations in the kitchen and at various regions of the vapor-collecting hood.

It is also possible to adjust the hood to changes in the layout of the kitchen and the various heat producing units thereof, to retrofit an existing kitchen with any particular layout of the heat producing equipment with the hood and, in general, to vary along the hood the air flows through the grease collecting filters.

Preferably, above the vapor-collecting space, a chamber is separated by a partition from this vapor-collecting space and contains the drive means for the jalousie carrier as well as the jalousie carrier itself. The partition, therefore, can protect the drive from contamination with grease or the like. The partition is provided with slits through which the shutters can extend.

To insure a complete sealing of the intake openings when required, the shutters can have, at their edges turned away from the jalousie carrier, a sealing strip engaging a wall of the intake opening. The sealing strip can have a width at least equal the width of the slit so that, when the shutter is drawn upwardly, its sealing strip can close the slit against the incursion of grease or contaminants. The sealing strip can, if necessary, be provided on the partition adjacent the shutter or on the wall of the intake opening engageable by the shutter.

The jalousie carrier is advantageously a one-piece bar which extends across all of the grease separating cells and can be guided at its end in respective guide rails. In an especially simple construction, the jalousie carrier can be connected with a chain passing over a sprocket wheel in the aforementioned chamber and having a free end extending through the vapor collection space which can be engaged by the user and employed to position the shutters. The chain can pass through an opening in the partition for that purpose.

Alternatively, the jalousie carrier can be connected to an electromechanically adjusted rotary spindle, to a linear/motor or, in an especially preferred and advantageous embodiment, to a rotary motor with an eccentric.

The grease filter is advantageously provided in the form of a cassette which has one end projecting into the vapor connection space and formed with the intake opening, a suction or discharge opening on the opposite side communicating with the exhaust duct and, between the intake opening and the air outlet opening, an array of tooth-shaped baffles engaging one between others and formed from baffle plates.

These baffle plates provide a labyrinth passage for the air and thus insure deposition of entrained grease.

The cassette can have a lower part and a cover part releasably attached to the lower part to enable opening of the cassette and the cleaning, the baffle teeth being provided alternately on the lower part and the cover.

The baffles are of V cross section and along their shanks and peripheral edges can be welded to the bottom part or cover part and the side walls thereof sealingly to prevent any penetration of grease into the baffles themselves but allowing ready access to the spaces between the baffles for cleaning.

The end of the cassette formed with the intake opening is inclined in a direction opposite the direction of another portion of this end formed with a handle enabling withdrawal of the cassette from the hood. Since the intake opening is elongated and comparatively narrow, the stroke or shutters between the unblocking and blocking positions can be limited.

The front and rear sides of the hood within the vapor-collecting space, lighting chambers are provided which are closed by safety glass and behind the electric lamps, preferably fluorescent tube lamps are provided to illuminate the space below the hood.

More particularly, a vapor-collecting hood for commercial kitchens can comprise:

- a housing forming a downwardly open vapor-accumulating space;
- an exhaust duct formed in the housing;
- a plurality of grease-trapping cells arranged in a row in the housing and each having:
  - an elongated intake opening communicating with the space and aligned with intake openings of adjacent cells,
  - a grease filter connected with the intake opening of the respective grease-trapping cell, and
  - an outlet downstream of the respective filter and communicating with the outlet duct;
- a shutter carrier common to all of the cells and mounted for movement in the housing generally transverse to the intake openings; and
- a respective shutter for each of the intake openings connected to the shutter carrier and displaceable thereby across the respective intake opening between an intake-opening-sealing blocking position and an unblocking position.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
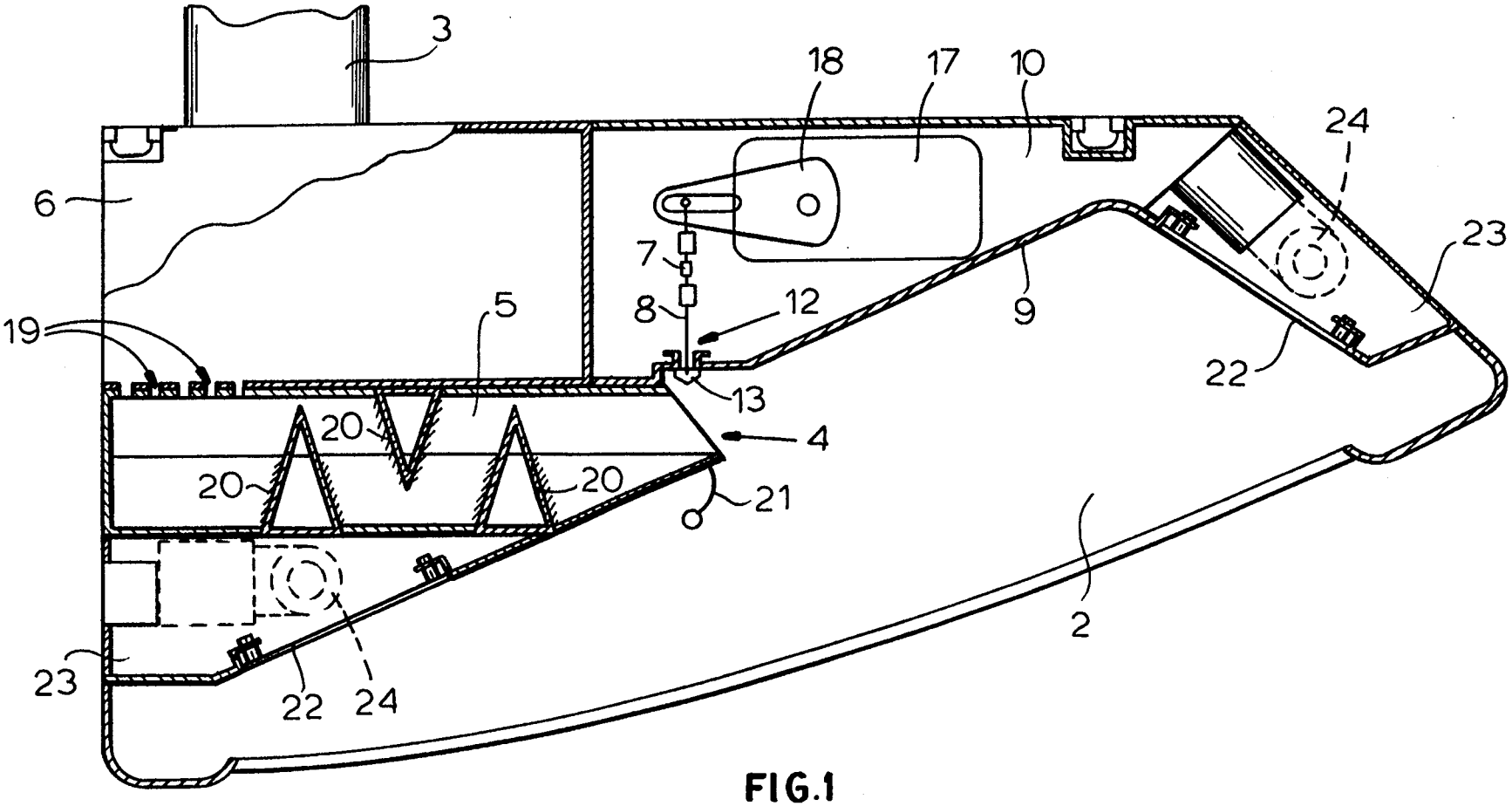
FIG. 1 is a side view in diagrammatic section illustrating a hood according to the invention.

The vapor-collecting hood shown in the drawing is intended for use primarily in commercial kitchens which have a number of heat generating units which may be disposed in a variety of patterns and requires various air flows at different times of the year and, if desired, at different locations along the hood. For this purpose, a multiplicity of grease separating cells 1 are disposed alongside one another and have downwardly open vapor-collecting spaces 2 in which respective intake openings 4 communicate to deliver the exhausted air to an exhaust gas duct 3. Between each intake opening 4 and the exhaust air duct 3, grease filters 5 are provided, above which a subatmospheric pressure plenum 6 is provided to communicate with the grease filters 5.

For the grease separating cells 1, in the region of the intake openings 4, a jalousie carrier 7 is provided, the jalousie carrier 7 being common to all of the grease separating cells 1 and extending substantially parallel to the intake openings 4 for movement substantially transversely to them.

Shutters 8 are connected to the jalousie or shutter carrier 7 and are displaceable with respect to the intake opening 4 from positions in which the opening 4 is unblocked (FIG. 1) to positions in which the shutters 8 close the intake openings.

In the blocked positions of the shutters practically no exhaust air passes through the grease separating cells. The position of the shutters is determined on the one hand by the arrangement of the hood with respect to the heating and cooking unit in the kitchen, the shutters being suspended at various heights from the carrier 7 in dependence upon the local flow desired and the shutter carrier being raised and lowered depending upon the overall heat and humidity generated in the kitchen on the one hand and by the requirements of winter and summer operation on the other. During the closing of the intake openings 4, in spite of the reduction of the total flow of exhaust air per unit time through the hood, there will be sufficient flow velocity through the grease collecting cells 1 which remain open to insure a high velocity of the air and thus a high grease separation efficiency in the grease filters 5.

Above the vapor-collecting spaces 2, a chamber 10 is separated off by means of a partition 9 receiving the shutter carrier 7 as well as the drive means for raising and lowering same. The partition 9 has one or more slits 12 through which the shutters 8 or each shutter 8 can extend.

At their edges turned away from the shutter carrier 7, each shutter 8 is formed with a sealing strip 13 to enable complete sealing of the intake opening 4 to allow the particular grease filter 5 to be completely closed off so that at no time is it necessary to operate with such reduced flow velocity that the exhausted air can pass through the filter 5 without depositing entrained grease therein.

The sealing strip 13 can be wide enough to close the slit 12 when the shutter 8 is not fully blocking the opening 4. Where shutters are removed to allow the openings 4 to remain unobstructed, sealing strips 13 can be inserted into the slit 12 to close the latter.

Figure 8:
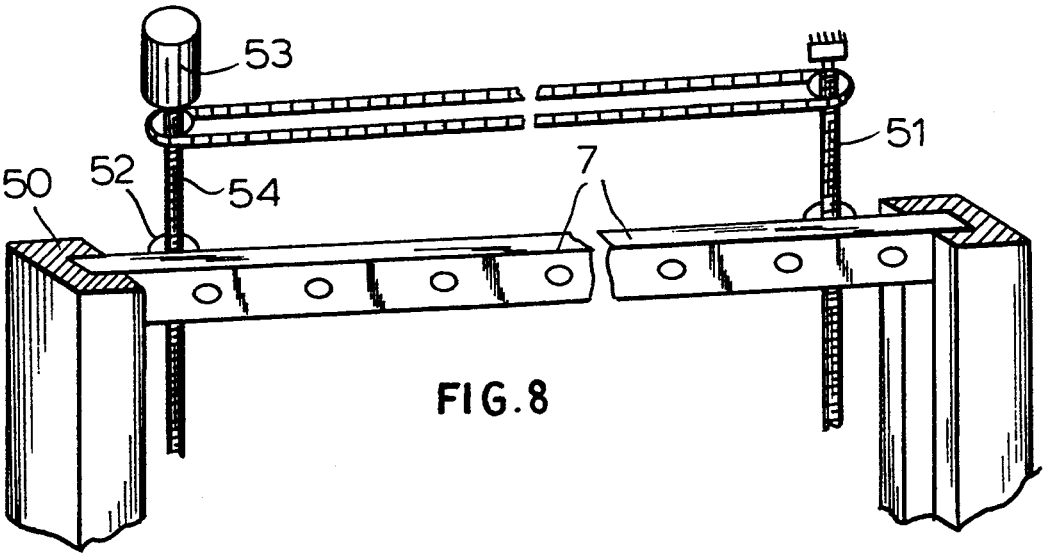
FIG. 8 is a diagram illustrating a rotary spindle drive for the shutter carrier.

Preferably, the shutter carrier 7 is a one-piece bar which extends across all of the grease separating cells 1 and can be guided as shown in FIG. 8 in rails 50.

Figure 2:
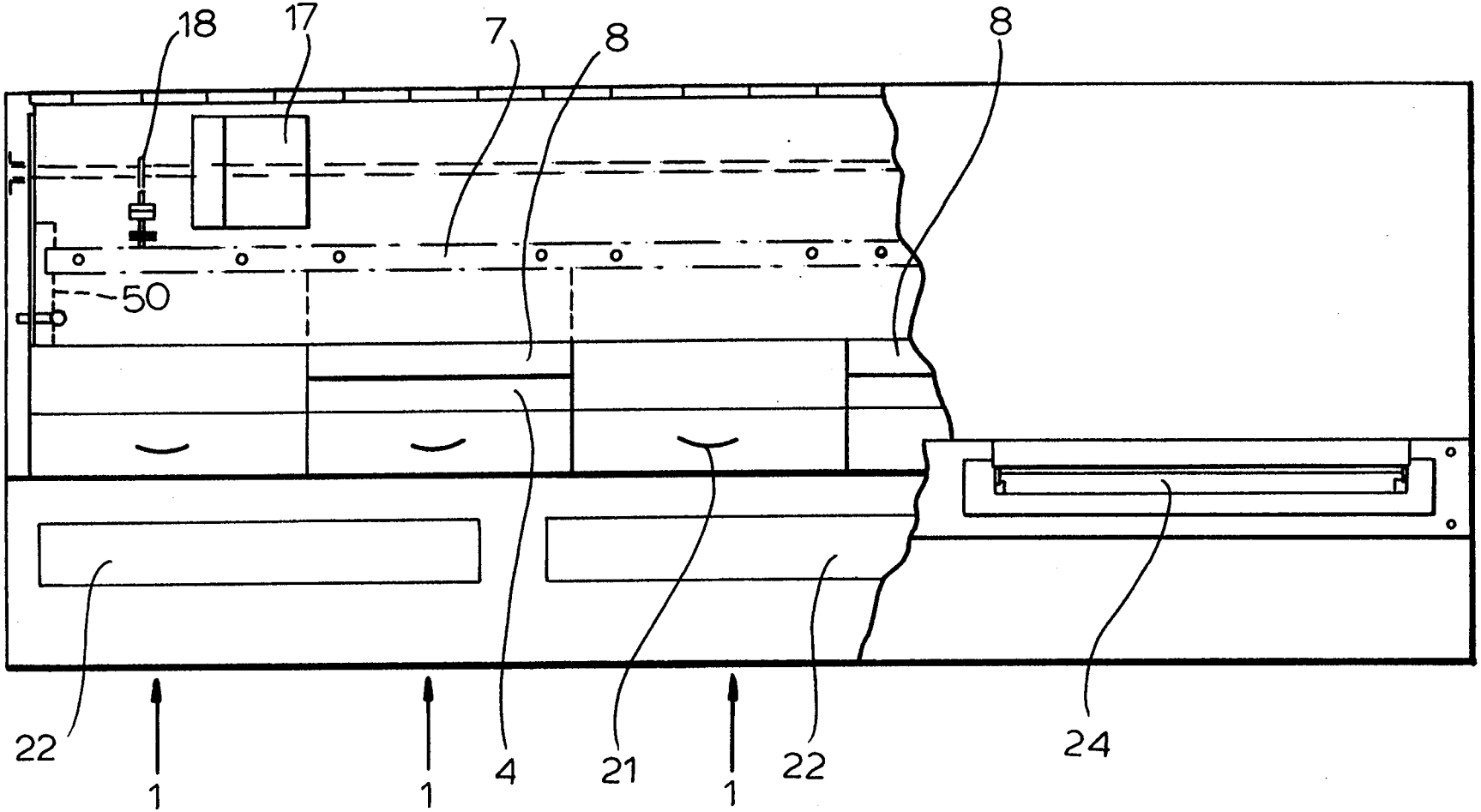
FIG. 2 is a highly diagrammatic front view partly broken away of the hood.

A portion of one such rail is also illustrated at 50 in FIG. 2.

FIG. 8 also shows that the shutter carrier 7 can be raised or lowered on rotary spindles 51 and can have nuts 52 for that purpose. The spindles 51 can be rotated by a hand wheel or an electric motor 53 as desired.

Figure 5:
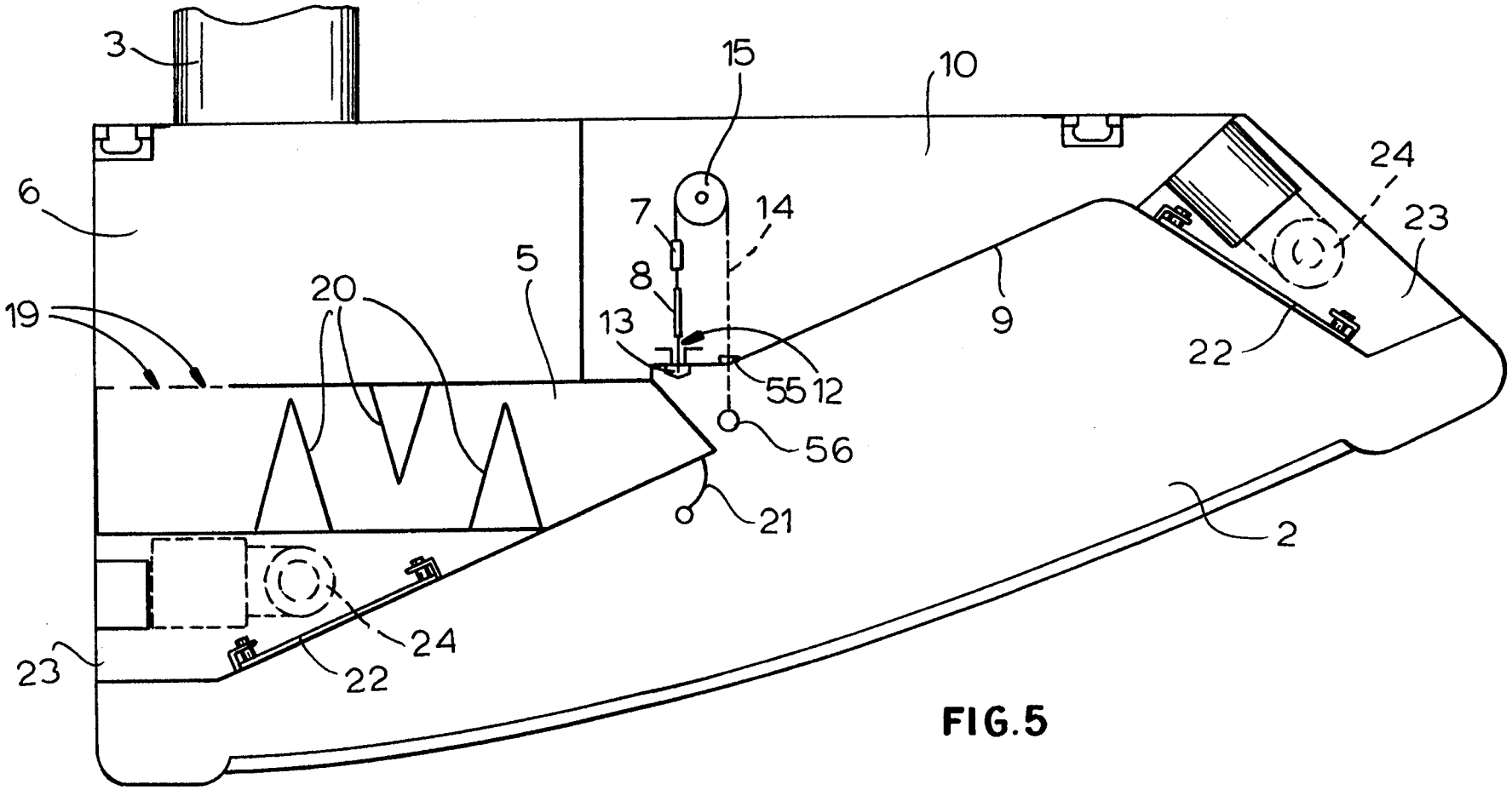
FIGS. 5 and 6 are other views similar to FIG. 1 showing different embodiments of the drives for the shutters.

In the embodiment of FIG. 5, the shutter carrier 7 is displaceable by a pull chain 14 passing over a sprocket wheel 15 in the chamber 10 and having a free end passing through an opening 55 in the partition 9 so that the free end 56 can be gripped by a worker in the kitchen to adjust the positions of the shutters.

Figure 6:
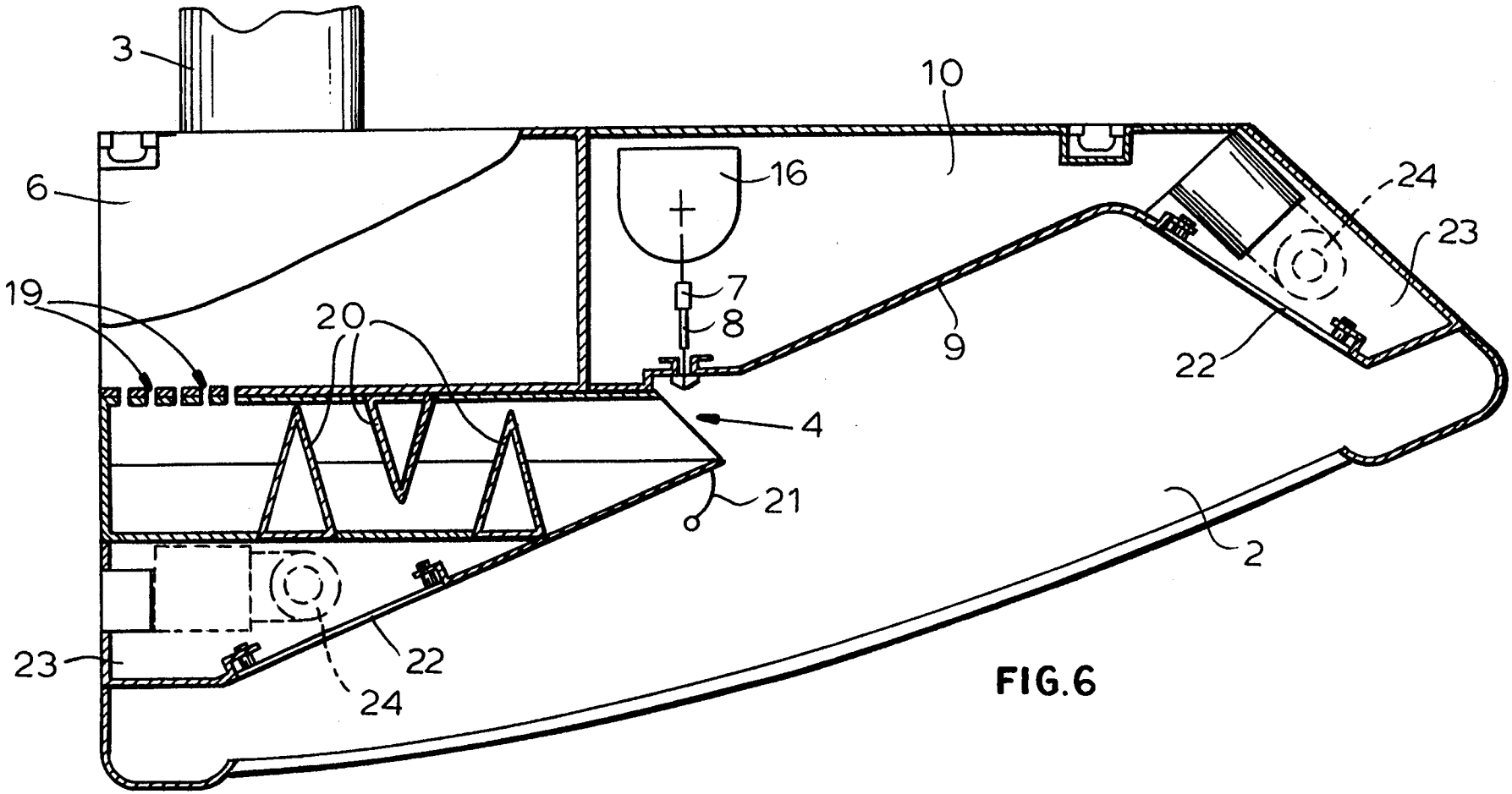

While this allows a manual adjustment of the shutter 8, to enable an automatic adjustment, the shutter carrier 7 can be adjusted by the electromechanical rotary spindles shown in FIG. 8. Alternatively, as has been illustrated in FIG. 6, a linear motor 16 can be provided in the chamber 10 and can be connected to the shutter carrier 7. In FIG. 1, the drive is a rotary motor 17 with an eccentric 18 connecting the motor to the shutter carrier 7. Between the motor and the eccentric 18, a stepdown transmission can be provided. The use of an electric motor adjustment of the shutters 8 facilitates automatic control in response to predetermined conditions in the kitchen, enabling for each condition a predetermined amount of air to flow through the hood and thus to be replaced in the kitchen.

Figure 7:
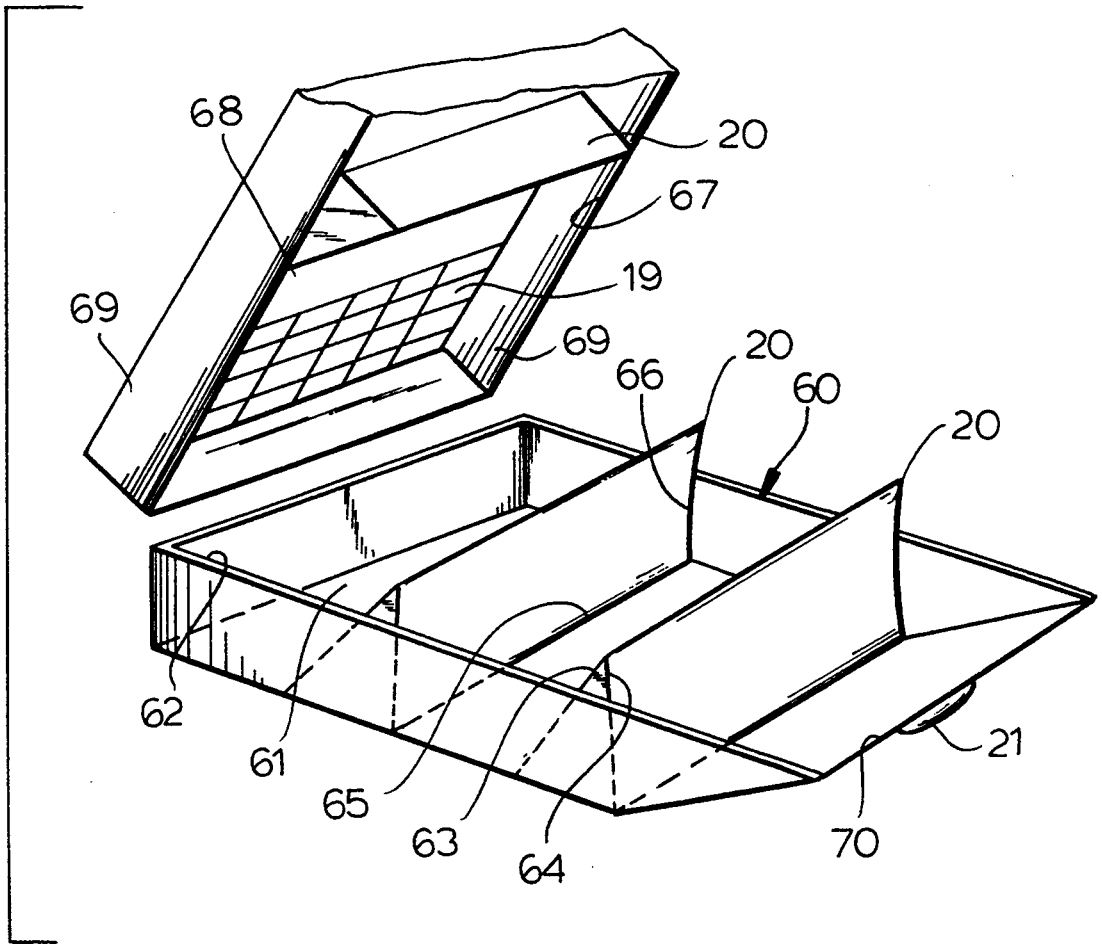
FIG. 7 is a perspective view of an open cassette forming one of the grease collecting filters.

The grease filters 5 are each disposed in a cassette formed at its inlet side with the respective opening 4 so that the openings 4 are lined up in the hood. At the side opposite the intake opening 4, each cassette has an air outlet 19 (FIGS. 1 and 7). Between the intake opening 4 and the air outlet 19, tooth like baffles 20 are provided with the upper and lower baffles extending between one another so that the baffles interdigitate and the air flow is deflected numerous times to effect baffle separation of grease from the entraining air.

As can best be seen from FIG. 7, the cassette can comprise a bottom part 60 with a bottom 61 and side walls 62 to which the plates 63 and 64 are welded along the edges 65 and 66 to fully close the interior of the V-shaped baffles from entry of grease. The baffle 20 of the cover portion 67 is similarly welded to the top wall 68 and the side walls 69 thereof. When only a cover plate is provided for the cassette, the baffle 20 thereof is not welded to side walls of the cover plate. In that case, the baffle is open at its ends and can be readily cleaned. The cassette can be cleaned in a washing and rinsing machine.

Figure 3:
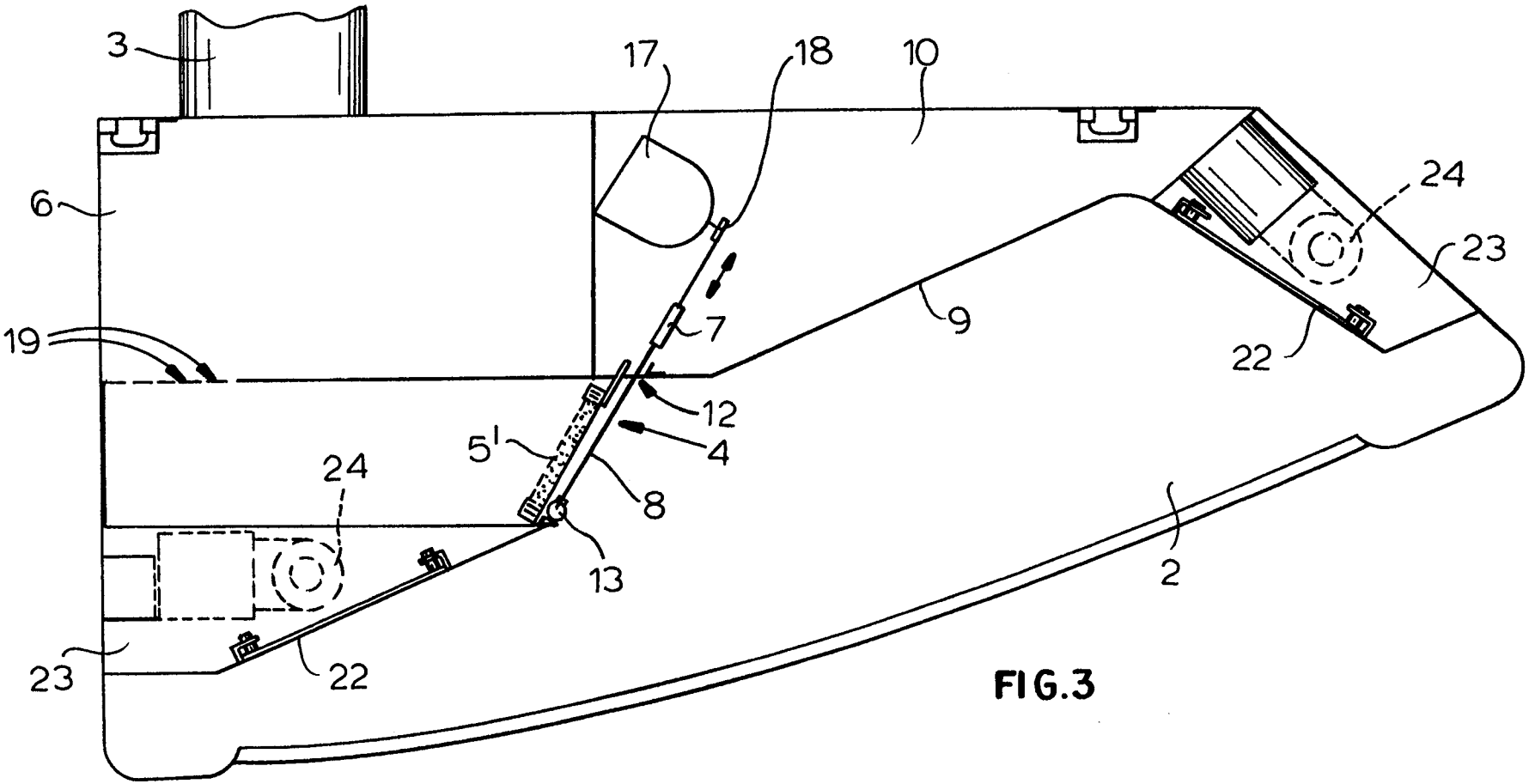
FIGS. 3 and 4 are views similar to FIG. 1 but illustrating other embodiments with different grease filters.

The end of the cassette formed with the intake opening 4 is inclined in two opposite directions. The upper portion is formed with the opening 4 while the lower portion 70 is closed and provided with a grip or handle 21 enabling the cassette to be withdrawn from the hood. The upper portion is thus of limited width so that the intake opening 4 is of correspondingly limited height. The narrow intake opening 4 insures a high velocity of flow with a comparatively small overall height of the cassette, a limited stroke of the shutter 8 and a similar overall height of the hood. In FIG. 3, I have shown a grease filter 5' which can be of the metal filter type and which can be removable from the cassette or simply inserted into the hood, as an alternative to the baffle type of grease filter of FIG. 1. In this embodiment, the shutter 8 is replaceable by an eccentric via the carrier 7, at an inclination to the vertical.

Figure 4:
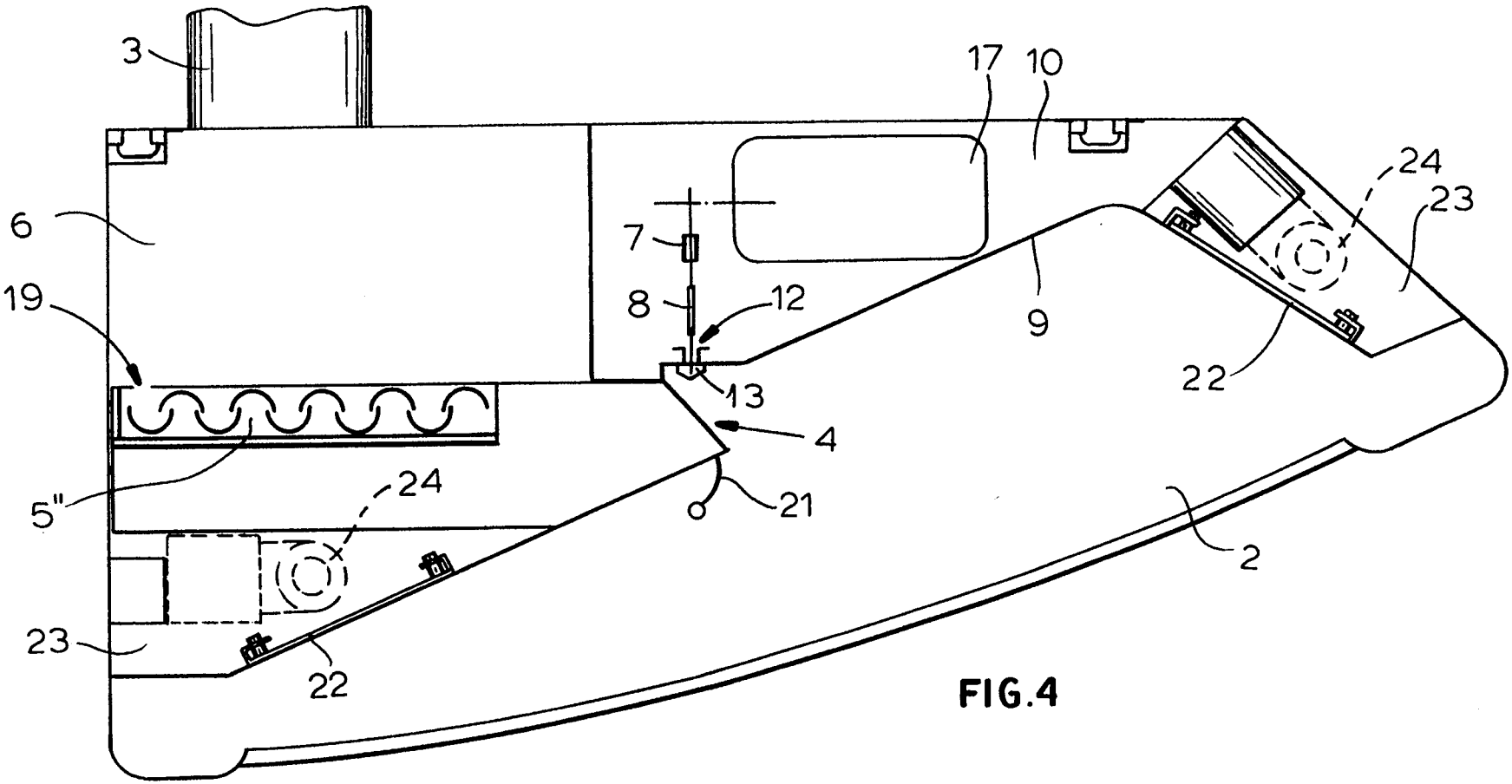

In the embodiment of FIG. 4, the cassette contains an impingement baffle grease filter 5'' of yet another design.

At the front end back of the hood, lighting chambers 23 are provided to receive fluorescent tube lamps 24, the light from which, passes through safety glass windows or panels 22 mounted in the hood.

As can be seen from FIG. 2, the grease-collecting cell on the extreme left and the third grease-collecting cell from the left are not provided with shutters 8 on the common carrier 7 and the respective intake openings are fully unblocked. Full circulation through these grease collectors is thereby ensured. The second grease-collecting cell from the left and the fourth grease-collecting cell from the left have shutters 8 connected to the common carrier 7 so that the throughput via these cells can be controlled to suit the air circulating needs of the kitchen. If desired, one or more of the grease-collecting cells can be removed and the connections with the plenum 6 of these omitted cells can be closed to eliminate unnecessary grease-collecting cells where the kitchen does not have corresponding grease-producing units. At these locations the shutters can be omitted from the carrier 7 as well.

I claim:

1. A vapor-collecting hood, especially for a commercial kitchen, comprising:

a housing forming a downwardly open vapor-accumulating space;

an exhaust duct formed in said housing;

a plurality of grease-trapping cells arranged in a row in said housing and each having:

an elongated intake opening communicating with said space and aligned with intake openings of adjacent cells, a grease filter connected with said intake opening of the respective grease-trapping cell, and an outlet downstream of the respective filter and communicating with said outlet duct;

a shutter carrier common to all of said cells and mounted for movement in said housing generally transverse to said intake openings; and a respective shutter for each of said intake openings connected to said shutter carrier and displaceable thereby across the respective intake opening between an intake-opening-sealing blocking position and an unblocking position.

2. The vapor-collecting hood defined in claim 1, further comprising means in said housing including:

a partition plate separating a chamber from said vapor-accumulating space, said chamber being disposed above said space, said shutter carrier being provided in said chamber, and drive means in said chamber for displacing said shutter carrier.

3. The vapor-collecting hood defined in claim 2 wherein said partition plate is formed with at least one slit through which said shutters pass.

4. The vapor-collecting hood defined in claim 3 wherein each of said shutters is formed with a sealing strip along an edge opposite an edge turned toward said shutter carrier.

5. The vapor-collecting hood defined in claim 4 wherein said sealing strips have widths dimensioned to correspond at least to a width of said slit whereby said sealing strips can seal said slits against said partition plate in a raised position of the respective shutter.

6. The vapor-collecting hood defined in claim 2 wherein said shutter carrier is a bar extending continuously across all of said cells.

7. The vapor-collecting hood defined in claim 6, further comprising guide rails engaging ends of said bar.

8. The vapor-collecting hood defined in claim 6 wherein said drive means includes a sprocket wheel mounted in said chamber, and a chain passing around said sprocket wheel, anchored to said bar and having a free end extending into said space to be gripped to actuate said shutters.

9. The vapor-collecting hood defined in claim 6 wherein said drive means includes an electromechanically adjustable rotary spindle.

10. The vapor-collecting hood defined in claim 6 wherein said drive means includes a linear stroke motor.

11. The vapor-collecting hood defined in claim 6 wherein said drive means includes a rotary motor having an eccentric coupled to said bar.

12. The vapor-collecting hood defined in claim 1 wherein said grease filter comprises a cassette having one end formed with the respective intake opening, an outlet at a side of the cassette opposite said one end, and between said one end and said outlet interfitting baffles.

13. The vapor-collecting hood defined in claim 12 wherein said cassette is composed of a lower part and a cover part sealingly fitting on said lower part and releasable therefrom, said baffles being alternatingly located on said lower and upper parts in a flow direction between said intake opening and said outlet.

14. The vapor-collecting hood defined in claim 13 wherein said baffles are formed by baffle plates in a V configuration with shanks sealingly welded side and bottom and top walls of said cassette, respectively.

15. The vapor-collecting hood defined in claim 14 wherein said one end of said cassette is angled in cross section with an upper portion inclined in one direction formed with the intake opening and a bottom portion inclined in an opposite direction formed with a handle enabling the cassette to be pulled out of said housing.

16. The vapor-collecting hood defined in claim 15, further comprising means in said housing including:

a partition plate separating a chamber from said vapor-accumulating space, said chamber being disposed above said space, said shutter carrier being provided in said chamber, and drive means in said chamber for displacing said shutter carrier.

17. The vapor-collecting hood defined in claim 16 wherein said partition plate is formed with at least one slit through which said shutters pass.

18. The vapor-collecting hood defined in claim 17 wherein each of said shutters is formed with a sealing strip along an edge opposite an edge turned toward said shutter carrier.

19. The vapor-collecting hood defined in claim 2 wherein said shutter carrier is a bar extending continuously across all of said cells, guide rails engaging ends of said bar.

20. The vapor-collecting hood defined in claim 1, further comprising lighting chambers formed in said housing at a front end and a rear end of said space, respective safety glass windows closing said lighting chambers, and respective lighting tube lamps in said lighting chambers.

* * * * *